US005678382A

United States Patent [19]

Naito

[11] Patent Number: 5,678,382

[45] Date of Patent: Oct. 21, 1997

[54] STRUCTURE OF BASE OF COLUMN AND CONSTRUCTION METHOD FOR BASE OF COLUMN

[76] Inventor: Kingo Naito, 7-4, Daiwa 2-chome, Takatsuki-shi, Osaka-fu, Japan

[21] Appl. No.: 572,102

[22] Filed: Dec. 14, 1995

[30] Foreign Application Priority Data

Dec. 19, 1994 [JP] Japan ..... 6-314608

[51] Int. Cl.[6] ..... E02D 27/00

[52] U.S. Cl. ..... 52/745.21; 52/295; 52/296; 52/299; 52/741.15

[58] Field of Search ..... 52/295, 296, 299, 52/745.21, 745.17, 745.18, 741.15, 741.14; 403/265, 270, 271; 405/239

[56] References Cited

U.S. PATENT DOCUMENTS

| | | | |
|---|---|---|---|
| 341,796 | 5/1886 | Craine | 52/295 |
| 1,334,519 | 3/1920 | Bushong | 52/295 |
| 5,505,033 | 4/1996 | Matsuo et al. | 52/295 X |

FOREIGN PATENT DOCUMENTS

| | | | |
|---|---|---|---|
| 87420 | 4/1991 | Japan | 52/295 |

*Primary Examiner*—Michael Safavi

*Attorney, Agent, or Firm*—Evenson, McKeown, Edwards & Lenahan P.L.L.C.

[57] ABSTRACT

A structure of base of column and a construction method for base of column formed by installing a lower end of column steel frame on a foundation formed under the ground. Plural column main reinforcing-bars, which have bottom bent portions and are incorporated in a foundation concrete at specified positions corresponding to a sectional shape of column, are protruded upward out of a top face of the foundation concrete and a lower end base plate of the column steel frame is combined to upper protruding portions of the column main reinforcing-bars. As combining measures, there are such measures that a tightening nuts are screwed onto male threaded portions provided on the protruding portions of the column main reinforcing-bars, or caulked portions are formed on the protruding portions of the column main reinforcing-bars. By these measures, a number of parts for combining the base of column and a construction cost can be reduced, a support strength of the column steel frame can be improved, and a number of construction work processes of the base of column can be reduced.

3 Claims, 7 Drawing Sheets

STRUCTURE OF BASE OF COLUMN AND CONSTRUCTION METHOD FOR BASE OF COLUMN

BACKGROUND OF THE INVENTION

1. Field of the invention

This invention relates to a structure of base of column and a construction method for base of column, in which a lower end of column steel frame is installed on a foundation of building.

2. Description of prior art

FIG. 3 is a general schematic view of a foundation constructed in the ground, in which a large number of foundations 1 are constructed along an external shape of building with intervals put between them and underground beams 2 connecting these foundations 1 are constructed.

Each foundation 1 is formed into a convex shape by a lower base concrete 4 and a column-shaped foundation concrete 5 placed on it. A column steel frame for each column is placed on top of the foundation concrete 5 to compose the base of column. As the structure of base of column and construction method for base of column, there are a fixed-type base of column system in which the column steel frame is fixed rigidly on the foundation 1 and a pin-type base of column system in which the column steel frame is connected through the pin rotatably to some extent.

In the later pin-type system, the foundation can be made small in its size because a load of building is carried mainly by beams between columns, however, the beams themselves become large so that weights of beam steel frame etc. on the ground increase and the ground work becomes troublesome.

In the former system, the beam between columns can be made small in its weight and size because the load of building is carried mainly by the columns. FIG. 10 shows a conventional example of the fixed beam of column.

Plural anchor bolts 8 together with plural column main reinforcing-bars 6 are incorporated in the concrete 5 of the foundation 1. The column main reinforcing-bars 6 have lower-end bent portions 6*a*, are arranged into a rectangular shape viewing from above and bound by hoop reinforcing-bars 7, and the entire column main reinforcing-bars 6 are buried in the foundation concrete 5 up to their upper edges. The anchor bolts 8 are disposed at eight places, for example, and supported by a support frame 9. Their upper ends protrude upward from a top face 11 of the foundation concrete 5 so as to be combined with a base plate 14 of the column steel frame 12 by nuts 13. The frame 9 holds the anchor bolts 8 with specified spaces put between them and functions effectively against an upward tension.

Problem to be solved

As shown in FIG. 10, when the anchor bolts 8 for combining the column steel frame and the support frame 9 are incorporated in the foundation 1 together with the column main reinforcing-bar 6, a material cost and weight and size of the foundation 1 become large and a number of process of foundation construction work for placing the anchor bolts increases so that a construction cost increases.

Plural beam main reinforcing-bars (not shown) of an underground beam 2 are installed in the foundation 1. However, when the anchor bolts 8 and the support frame 9 exist in the foundation 1, an arrangement space for beam main reinforcing-bar is restricted to a large extent and a bar arrangement work for beam main reinforcing-bar becomes very troublesome. There may be a case where the beam main reinforcing-bar should be bent and installed in the foundation.

SUMMARY OF THE INVENTION (Structure of the invention)

In order to solve the above problem, one advantageous embodiment of the present invention provides a structure of base of column formed by installing a lower end of column steel frame on a foundation formed under the ground, in which plural column main reinforcing-bars that are incorporated in a foundation concrete into a specified arrangement corresponding to a column sectional shape, are protruded upward out of a top face of the foundation concrete and a lower-end base plate of a column steel frame is combined to an upward protruding portion of the column reinforcing-bars.

In order to simplify a combining structure of a column main reinforcing-bar with a column steel frame, another advantageous embodiment of the present invention provides a structure of base of column in which column main reinforcing-bar passing holes corresponding to respective column main reinforcing-bars are made on the base plate, and caulked portions for holding the base plate are formed on the protruding portions of the column main reinforcing-bars passed through the column main reinforcing-bar passing holes.

In order to carry out a verticality adjustment of the column steel frame simply and correctly, another advantageous embodiment of the present invention provides a structure of base of column in which a column main reinforcing-bar passing holes corresponding to respective column main reinforcing-bar are made on the base plate, male threaded portions are formed on outer peripheral sides of the upward protruding portions of the column main reinforcing-bars, and nuts for holding the base plate are screwed onto the male threaded portions passed through the column main reinforcing-bar passing holes.

In order to more firmly combine the column steel frame with the column main reinforcing-bar and to carry out a verticality adjustment of the column steel frame simply and correctly, another advantageous embodiment of the present invention provides a structure of base of column in which a column main reinforcing-bar passing holes corresponding to respective column main reinforcing-bars are made on the base plate, male threaded portions are formed on outer peripheral sides of the protruding portions of some column main reinforcing-bars, among those passed through the column main reinforcing-bar passing holes, nuts for holding the base plate are screwed onto the male threaded portions, and caulked portions for holding the base plate are formed on protruding portions of the other main reinforcing-bars.

Another advantageous embodiment of the present invention provides a construction method for forming the base of column in which a foundation of building is formed under a state where upper ends of the column main reinforcing-bars are protruded out of the top face of the foundation concrete, the upper end protruding portions of the column main reinforcing-bars are inserted in the column main reinforcing-bar passing holes of the lower end base plate of the column steel frame so as to combine the protruding portion of the column main reinforcing-bars to the base plate.

Another advantageous embodiment of the present invention provides a construction method for forming the base of column in which a foundation of building is formed under a state where the upper ends of the column main reinforcing-bars are protruded out of the top face of the foundation concrete, the upper end protruding portions of the column main reinforcing-bars are inserted in the column main reinforcing-bar passing holes of the lower end base plate of the column steel frame so as to combine the base plate to the column main reinforcing-bars by heating and pressing the protruding portion of the column main reinforcing-bars.

In order to secure the column steel frame by the caulking work simply and correctly, another advantageous embodiment of the present invention provides a construction method for forming the base of column in which a foundation of building is formed under a state where the upper ends of the column main reinforcing-bar are protruded out of the top face of the foundation concrete, the upper end protruding portions of the column main reinforcing-bars are inserted in the column main reinforcing-bar passing holes of the lower end base plate of the column steel frame, sealing seats having tapered holes enlarged toward upside are placed on upper parts of respective passing holes, and widened portions having conical portions fitted in the tapered holes are formed by caulking the protruding portions of the column main reinforcing-bars so as to combine the base plate to the column main reinforcing-bars.

In order to carry out a verticality adjustment of the column steel frame simply and correctly, another advantageous embodiment of the present invention provides a structure of base of column in which a foundation of building is formed under a state where the upper ends of the column main reinforcing-bars are protruded out of the top face of the foundation concrete, the upper end protruding portions of the column main reinforcing-bars are inserted in the column main reinforcing-bar passing holes of the lower end base plate of the column steel frame, nuts are screwed onto the male threaded portions formed on the outer peripheral sides of protruding portions of some column main reinforcing-bars so as to adjust a verticality of column main steel frame, and protruding portions of the other column main reinforcing-bars are caulked so as to combine the base plate to the column main reinforcing-bars.

In order to more firmly combine the column steel frame with the column main reinforcing-bars and to carry out a verticality adjustment of the column steel frame simply and correctly, another advantageous embodiment of the present invention provides a structure of base of column in which a foundation is formed under a state where upper ends of the column main reinforcing-bars are protruded out of the top face of the foundation concrete, the upper end protruding portions of the column main reinforcing-bars are inserted in the column main reinforcing-bar passing holes of the lower end base plate of the column steel frame so that the verticality of column main steel frame is adjusted by screwing the nuts onto the male threaded portions formed on the outer peripheral sides of protruding portions of some column main reinforcing-bars and the base plate is combined to the column main reinforcing-bars by heating and pressing the protruding portions of the other column main reinforcing-bars.

(Effect of the invention)

According to the inventions of this application as described above, the following effects can be obtained.

(1) The column steel frame 40 is fixed by combining the base plate 41 of the column steel frame 40 to the upper ends of the column main reinforcing-bars 25 incorporated in the foundation 1. Accordingly, it becomes unnecessary to install the anchor bolts so that the material cost of the foundation 1 can be reduced and its weight and size can be minimized. In addition, the number of construction work process can be reduced.

(2) The anchor bolt of the foundation 1 can be eliminated. Accordingly, in the bar arrangement work before placing the foundation concrete, an arrangement space of beam main reinforcing-bar for underground beam intersecting with the column main reinforcing-bar 25 etc. can be secured easily so that the bar arrangement work becomes easy.

(3) In general, the base plate 41 of the column steel frame 40 can be combined to the column main reinforcing-bar 25 firmly buried in the foundation owing to lower end bent portions 25*a*. Accordingly, a support strength of the column steel frame 40 is improved as compared with the conventional case where it is combined to the anchor bolt. By this structure, it becomes possible to further minimize the size and weight of underground beam.

(4) When the column main reinforcing-bars 25 are combined to the column steel frame 40 by means of the widened portions 37 formed on the column main reinforcing-bar 25, the combining structure can be simplified.

(5) As described in the inventions set forth in claims 3 and 8, the male threaded portions 34 are formed on the outer peripheral sides of upward protruding portions 25*b* of the column main reinforcing-bars 25 and the nuts 49 for holding the base plate 41 is screwed onto the male threaded portions 34, so that the column main steel frame 40 can be combined to the column main reinforcing-bars 25 more firmly. Accordingly, the verticality adjustment of the column steel frame 40 can be carried out simply and correctly, too.

(6) As described in the inventions set forth in claims 4 and 9, the combining work utilizing the widened portions 37 formed on some column main reinforcing-bars 25 is done together with the combining work by screwing the nuts 49 onto the male threaded portions 34 formed on the other column main reinforcing-bars 25. Accordingly, the column steel frame 40 can be combined with the column main reinforcing-bars 25 more firmly and the verticality adjustment of the column steel frame 40 can be carried out simply and correctly, too.

(7) As described in the invention set forth in claim 7, the foundation 1 of building is formed under a state where upper ends of the column main reinforcing-bars 25 are protruded out of the top face of the foundation concrete 5, the upper ends protruding portions 25*b* of the column main reinforcing-bars 25 are inserted in the column main reinforcing-bar passing holes 42 of the lower end base plate 41 of the column steel frame 40, and sealing seats 46 having tapered holes 46*a* enlarged toward upside are placed on upper parts of respective passing holes 42, and widened portions 37 having conical portions 37*a* fitted in the tapered holes 46*a* are formed by heating and pressing the protruding portions 25*b* of the column main reinforcing-bars 25 so as to combine the base plate 41 to the column main reinforcing-bars 25. Accordingly, the column steel frame 40 can be fixed firmly by the heating and pressing work simply and correctly.

DESCRIPTION OF THE PREFERRED EMBODIMENTS

Figure 1:
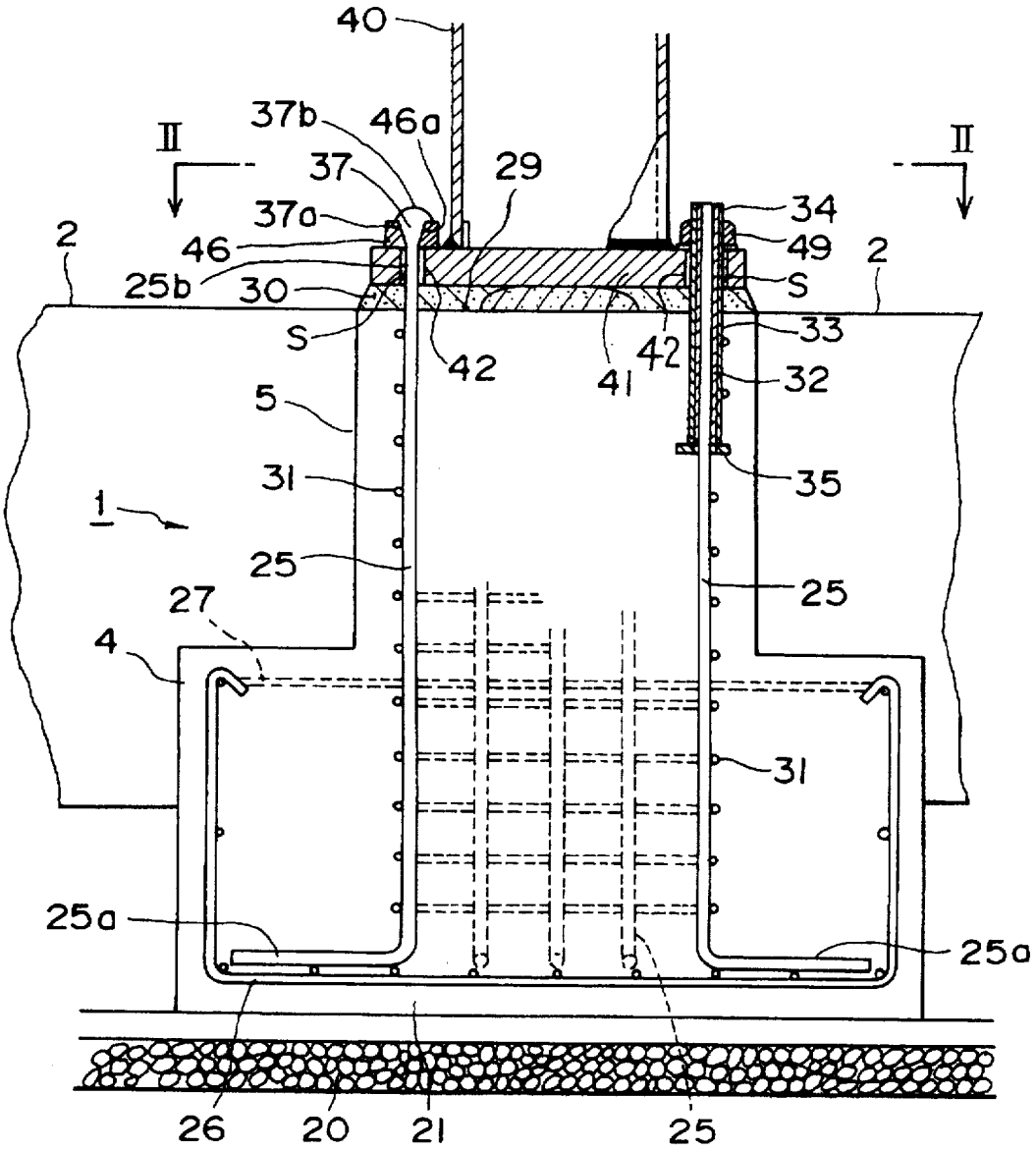
FIG. 1 is a vertical sectional view of the base of column according to a preferred embodiment of the present invention.
Figure 2:
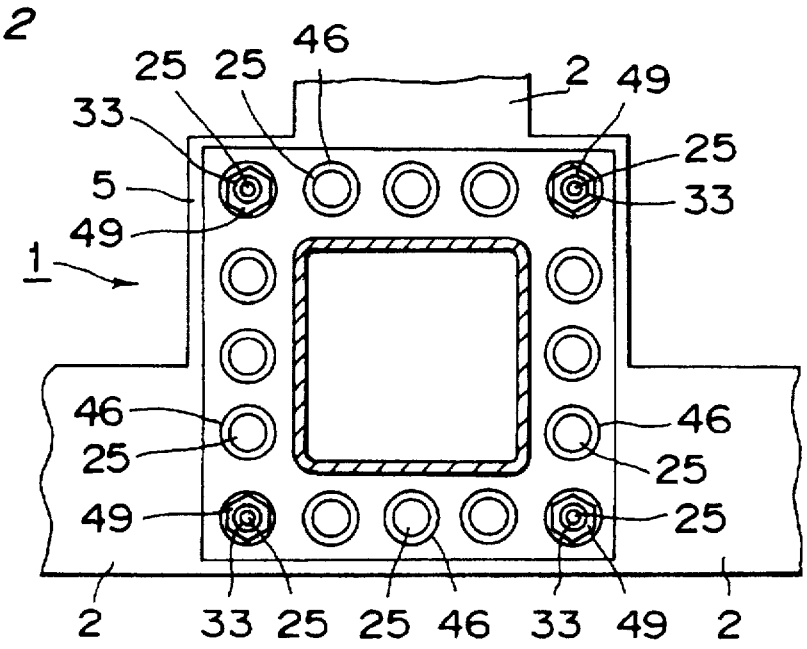
FIG. 2 is a sectional view taken on a line II—II of FIG. 1.
Figure 3:
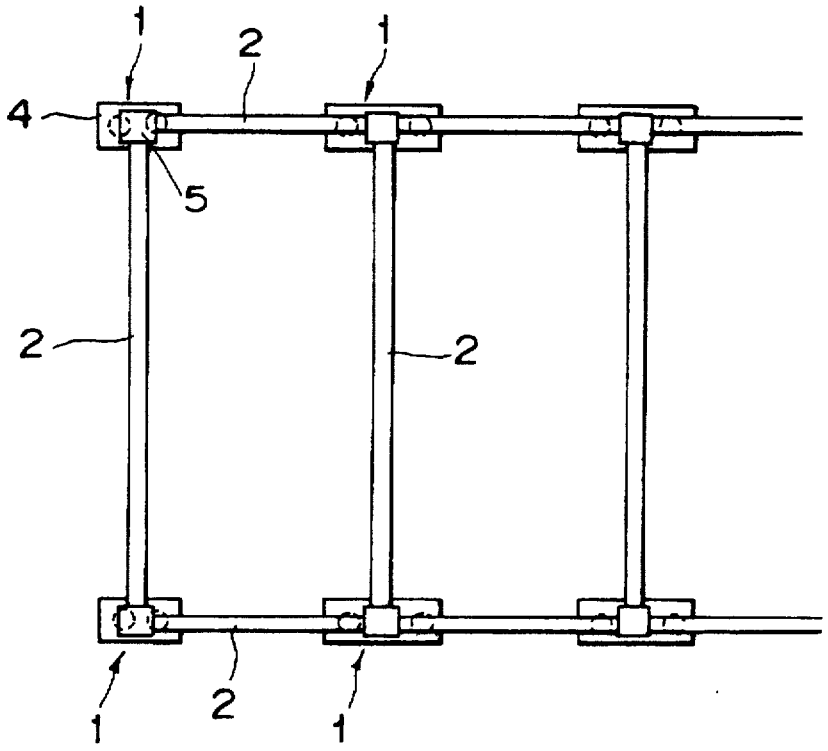
FIG. 3 is a general plan view showing the foundation of building.

FIG. 1 and FIG. 2 show the base of column of building to which the inventions are applied. Respective symbols of the foundation 1, the underground beam 2, the base concrete 4, the foundation concrete 5 of the foregoing FIG. 3 are used in these figures in the same way as explained in the description of prior art.

In FIG. 1 showing the vertical sectional view, a cobble stone layer 20 and a leveling concrete layer 21 are formed in this order from the bottom level of an excavated hole, and the foundation 1 is formed on an upper surface of the leveling concrete layer 21.

The foundation 1 is integrally formed into a convex shape by the lower base concrete 4 and the upper foundation concrete 5 forming a column shape, and at the same time the earth beam 2 is formed integrally too.

In the base concrete 4, there are installed plural base reinforcing-bars 26 formed into upward opening U-shapes and plural column main reinforcing-bars 25 having horizontal bent portions 25*a* at their bottoms. The base reinforcing-bars 26 are placed in latticed positions viewing from upside and bound by hoop reinforcing-bars 27. The column main reinforcing-bars 25 are arranged in positions within an inside area of the base reinforcing-bars 26 so that they can be incorporated within a region of a horizontal sectional area of the foundation concrete 5. The bottom bent portions 25*a* are arranged at positions fronting outsides, extend vertically upward from bottom parts in the base concrete 4, passes through the foundation concrete 5, and protrude upward through a non-shrinkable mortar layer 30 from the top face 29. In other words, the column main reinforcement 25 have protruding portions 25*b* which protrude upward from the top face 29 and the non-shrinkable mortar layer 30.

The column main reinforcing-bars 25 are arranged into a rectangular shape viewing from upside as shown in FIG. 2, so that they are located along an external shape of the column-type foundation concrete 5. In this embodiment, they are arranged at sixteen places and bound into a specified cage shape by plural rectangular hoop reinforcing-bars 31 as shown by FIG. 1.

Among sixteen column main reinforcing-bars 25, cylindrical sleeve anchors 33 are fitted onto outer peripheries of four column main reinforcing-bars 25 at four corners (right-side column main reinforcing-bar of FIG. 1) through bond layers 32. Annular flange-shaped anchor seats 35 are welded to bottom portions of the sleeve anchors 33, and male threaded portions 34 are formed on top outer peripheral surfaces.

Widened portions 37 having conical faces 37*a* enlarged toward upside are formed at upper parts of the remaining column main reinforcing-bars (left-side column main reinforcing-bar of FIG. 1).

The foregoing non-shrinkable mortar layer 30 having a specified height is formed at an upper side of the top face 29 of the foundation concrete 5. The bottom base plate 41 of the column steel frame 40 is placed on the non-shrinkable mortar layer 30, and combined firmly to the column main reinforcing-bar 25 by the sleeve anchor 33 and the widened portion 37 of the column main reinforcing-bar 25.

The structure for combining the column main reinforcing-bar 25 to the base plate 41 will be explained in details. Column main reinforcing-bar passing holes 42 are made on the base plate 41 at positions corresponding to respective column main reinforcing-bars 25. A diameter of the column main reinforcing-bar passing hole (hole shown at left side of FIG. 1) 42 corresponding to the column main reinforcing-bar 25 having the widened portion 37 is so determined as to include a fixed error adjusting clearance S on each side in addition to a diameter of the column main reinforcing-bar 25. A sealing seat 46 having a tapered hole 46*a* enlarged toward upside is welded to an upper side of the passing hole 42.

A diameter of the column main reinforcing-bar passing hole (hole shown at right side of FIG. 1) 42 corresponding to the column main reinforcing-bar 25, in which the sleeve anchor 33 is fitted, is so determined as to include a fixed error adjusting clearance S on each side in addition to an outer peripheral diameter of the sleeve anchor 33.

The column main reinforcing-bar 25 and the sleeve anchor 33 pass the corresponding column main reinforcing-bar passing holes 42 to upper sides, the tightening nuts 49 are screwed onto the male threaded portions 34 formed at outer peripheral sides of the sleeve anchors 33 so as to tighten the base plate 41 toward lower side. On the other hand, the conical faces 37*a* of the widened portions 37 of the remaining column main reinforcing-bars 25 fit in the tapered holes 46*a* of the sealing seats 46 with a fixed strong pressure, and at the same time the upper umbrella-shaped portions 37*b* press upper faces of the sealing seats 46 downward.

In other words, owing to the tightening structure of the male threaded portion 34 of the sleeve anchor 33 with the nut 49 and the sealing structure composed of the widened portion 37 utilizing the taper fitting, the column main reinforcing-bars 25 are firmly combined to the base plate 41 of the column steel frame 40 and the base plate 41 of the column steel frame 40 is firmly fixed onto the foundation concrete 5 through the non-shrinkable mortar layer 30.

An example of construction method for constructing the base of column shown in FIG. 1 will be explained.

Figure 4:
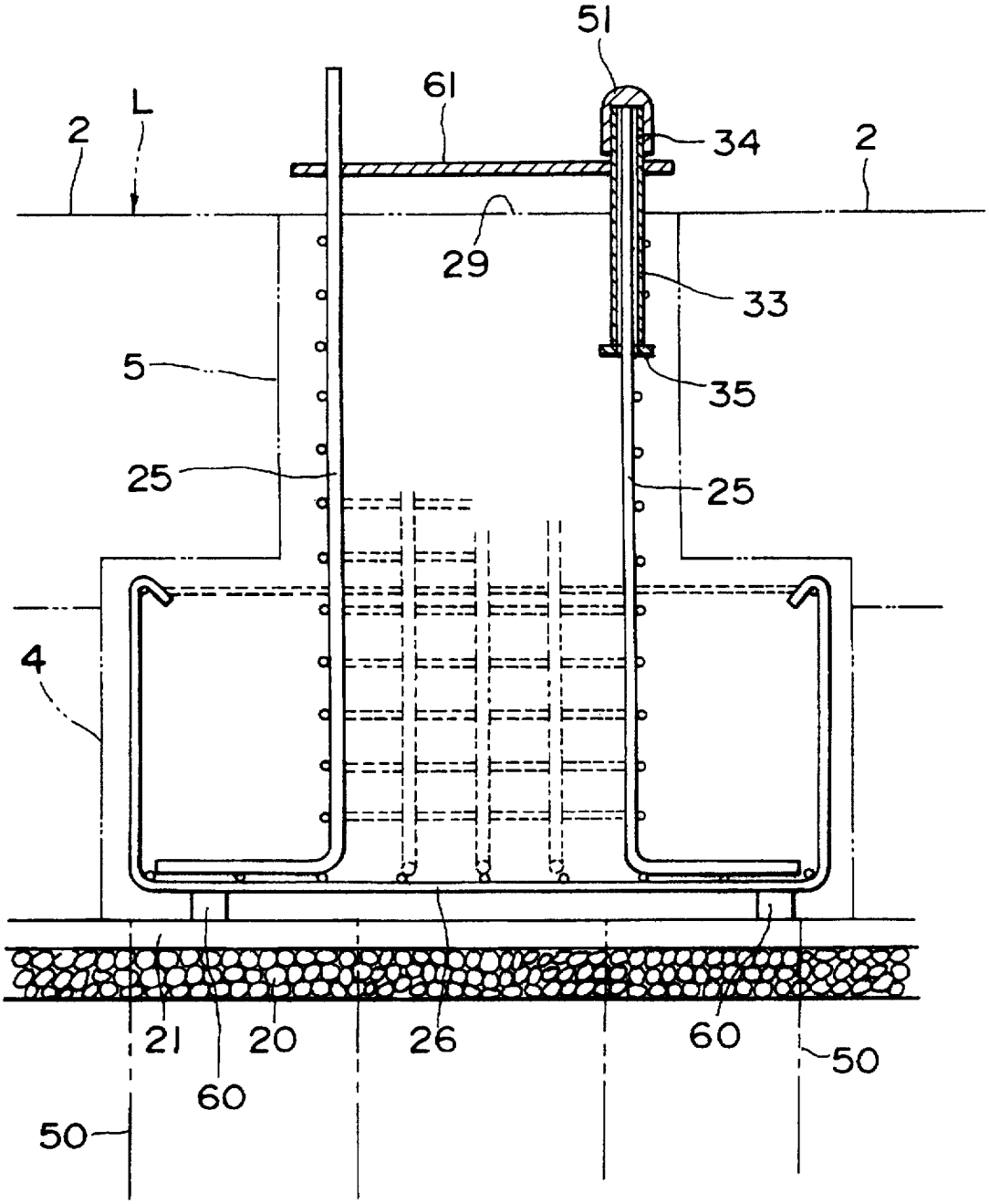
FIG. 4 is a vertical sectional view at time of bar arrangement process of the construction method of base of column according to a preferred embodiment of the present invention.

(1) In FIG. 4, cobble stones are placed on a bottom of hole made by excavating the ground to a specified depth so as to form a cobble stone layer 20, and a leveling concrete layer 20 is formed on it. Underground piles 50 such as made of concrete for strengthening the ground are installed at places on which the foundation 1 is constructed.

(2) The base reinforcing-bars 26 are assembled into a latticed shape viewing from upside and put in upward opening U-shaped positions in their vertical sections, and the column main reinforcing-bars 25 are assembled into a rectangular hollow-shaped column in their horizontal sections. Deformed bars having convex portions of helical or other patterns on their outer peripheral surfaces are used for the base reinforcing-bars 26 and the column main reinforcing-bars 25.

(3) An assembly of the base reinforcing-bars 26 is placed on a specified position on the ground piles 50 through plural cubic 5locks 60, and an assembly of the column main reinforcing-bars 25 is placed on a specified position of the assembly of the base reinforcing-bars 26.

(4) The sleeve anchors 33, which integrally have annular flange-shaped anchor seats 35 at their bottoms, are previously fitted onto upper end portions of the column main reinforcing-bars 25 at four corners. The sleeve anchor 33 has a male threaded portion 34 on its upper outer peripheral surface, and a cap 51 for preventing falling-off and protecting from concrete is screwed or fitted onto the male threaded portion 34. A bottom face of the cap 51 is made contact with a top face of the column main reinforcing-bar 25, so that the sleeve anchor 33 is temporarily held at a specified height.

(5) The sleeve anchor 33 is fitted onto the column main reinforcing-bar 25 in such a manner that a clearance, which is small to an extent that it can be filled with a bond, is left between the sleeve anchor and an outer peripheral surface of the column main reinforcing-bar 25.

(6) A positioning jig 61 for correctly positioning the column main reinforcing-bars to specified positions each other is fitted onto upper parts of the column main reinforcing-bars 25 and the sleeve anchors 33, and secured by an appropriate temporary metal such as a clamp etc.

(7) Not-shown beam main reinforcing-bars for the underground beam 2 are placed between the column main reinforcing-bars.

(8) After assembling all the column main reinforcing-bars 25, the base reinforcing-bars 26 and the beam reinforcing-bars, concrete molds for foundation and underground beam are installed, and concrete is then placed so as to integrally form the base concrete 4, the foundation concrete 5 and the underground beam 2 as shown by imaginary lines. In this instance, the column main reinforcing-bars 25 and the sleeve anchors 33 protrude upward for a specified height from the top face 29 of the foundation concrete 5.

(9) After placing the concrete, soil is back filled up to a level L same with those of the foundation concrete 5 and the top surface 29.

Figure 5:
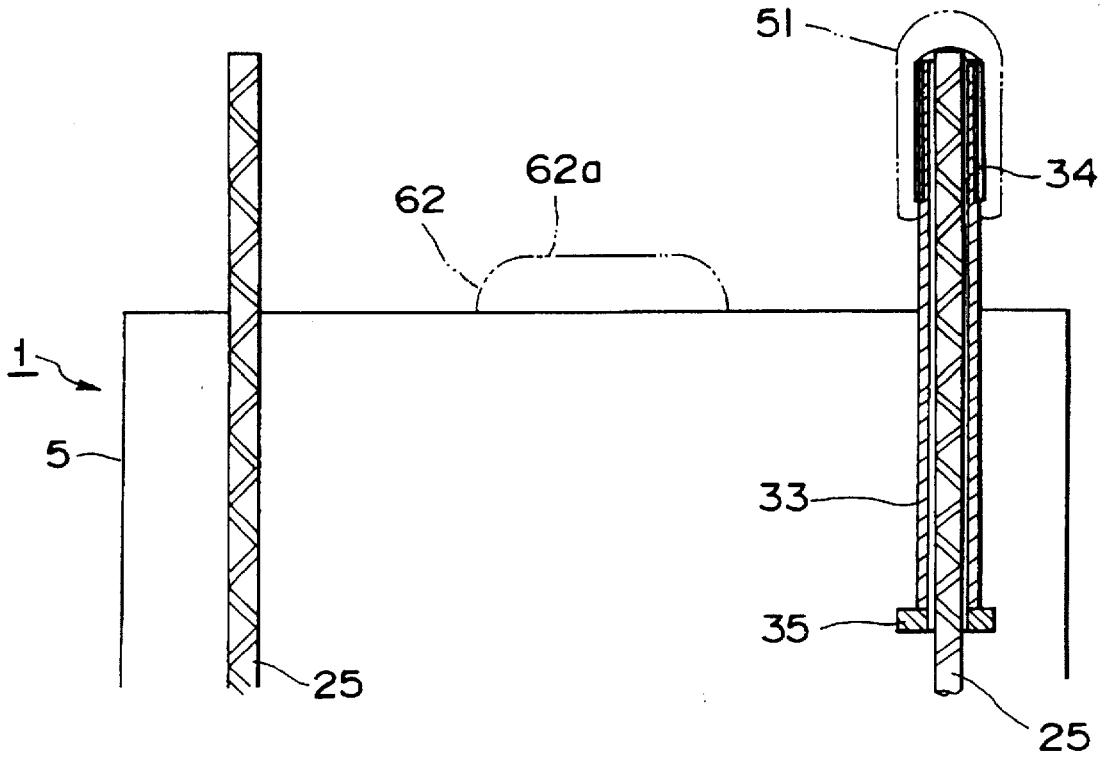
FIG. 5 is a vertical sectional view of an upper part of foundation after completion of concrete placing.
Figure 6:
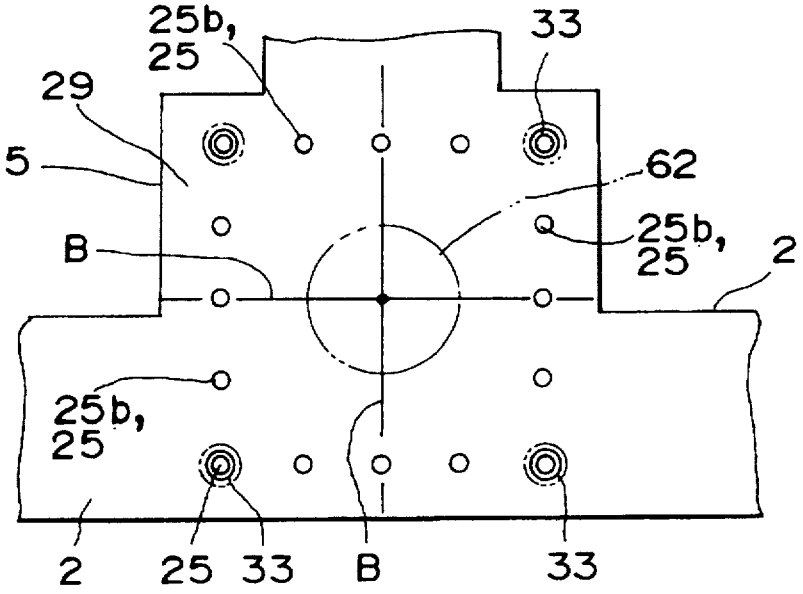
FIG. 6 is a plan view of FIG. 5.

(10) After forming the foundation 1 as described above, a cross mark B for positioning a center of column steel frame is made on the top face 29 of the foundation concrete 5 as illustrated in FIG. 6. At the same time, a level adjusting mortar bed 62 is formed at the center part into a convex shape, for example, as shown by FIG. 5. A top face **62*a* of the mortar bed 62 provides a datum plane of a height of the column steel frame in order to keep a horizontalness of the surface beam. Therefore, the top face is to be finished correctly to a specified height by a trowel etc. so that all the mortal bed top faces 62*a* of the foundation 1 are aligned to the same level. Then, caps 5 of the beam main reinforcing-bars 25** at four corners are removed.

Figure 7:
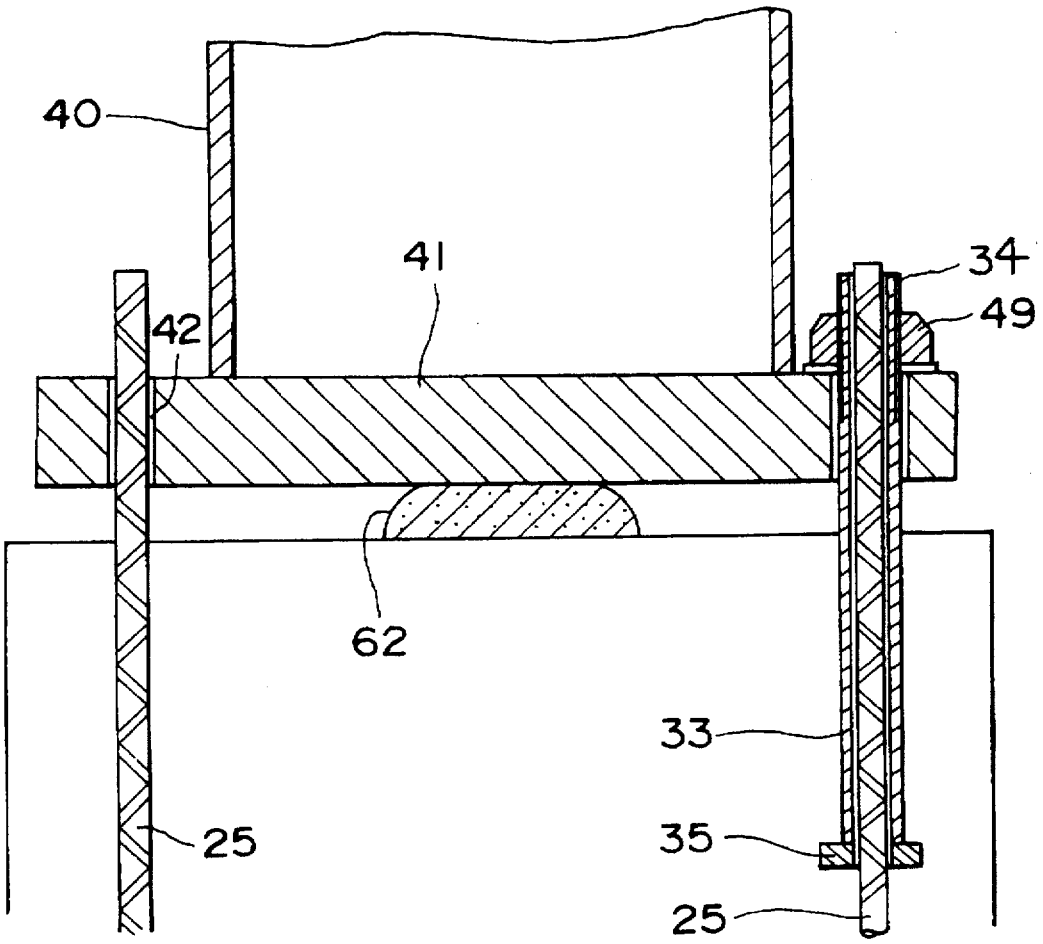
FIG. 7 is a vertical sectional view of an upper part of foundation at time of verticality adjustment process of the column steel frame.

(11) In FIG. 7, the column steel frame 40 is hung up by a crane etc. Then, the column main reinforcing-bars 25 and the sleeve anchors 33 are made pass through respective column main reinforcing-bar passing holes 42 of the base plate 41. After that, the steel frame is placed on the level adjusting mortar bed 62.

(12) The tightening nuts 49 are screwed onto the upper male threaded portions 34 of the four sleeve anchors 33 to temporarily tighten the column steel frame 40.

Figure 8:
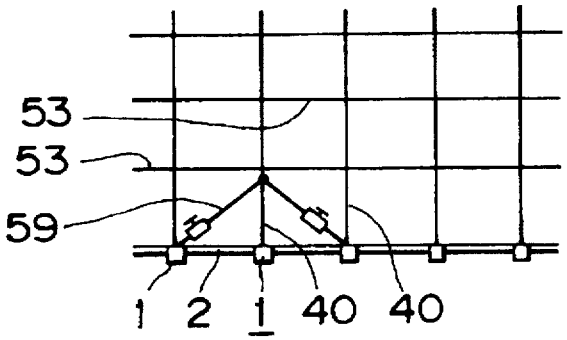
FIG. 8 is a general schematic front view of erection at time of verticality adjustment process of the column steel frame.

(13) The surface beams 53 are assembled to respective column steel frames 40 as shown by FIG. 8. Verticality adjusting truss wires 59 are attached to voluntary column steel frames 40 in approximately diagonal directions, and tensions of the truss wires 59 are adjusted by a structure such as a turnbuckle etc. At the same time, a verticality of the column steel frame 40 and a horizontalness of the beam steel frame 53 are adjusted by adjusting tightening degrees of the nuts 49 of FIG. 7.

Figure 9:
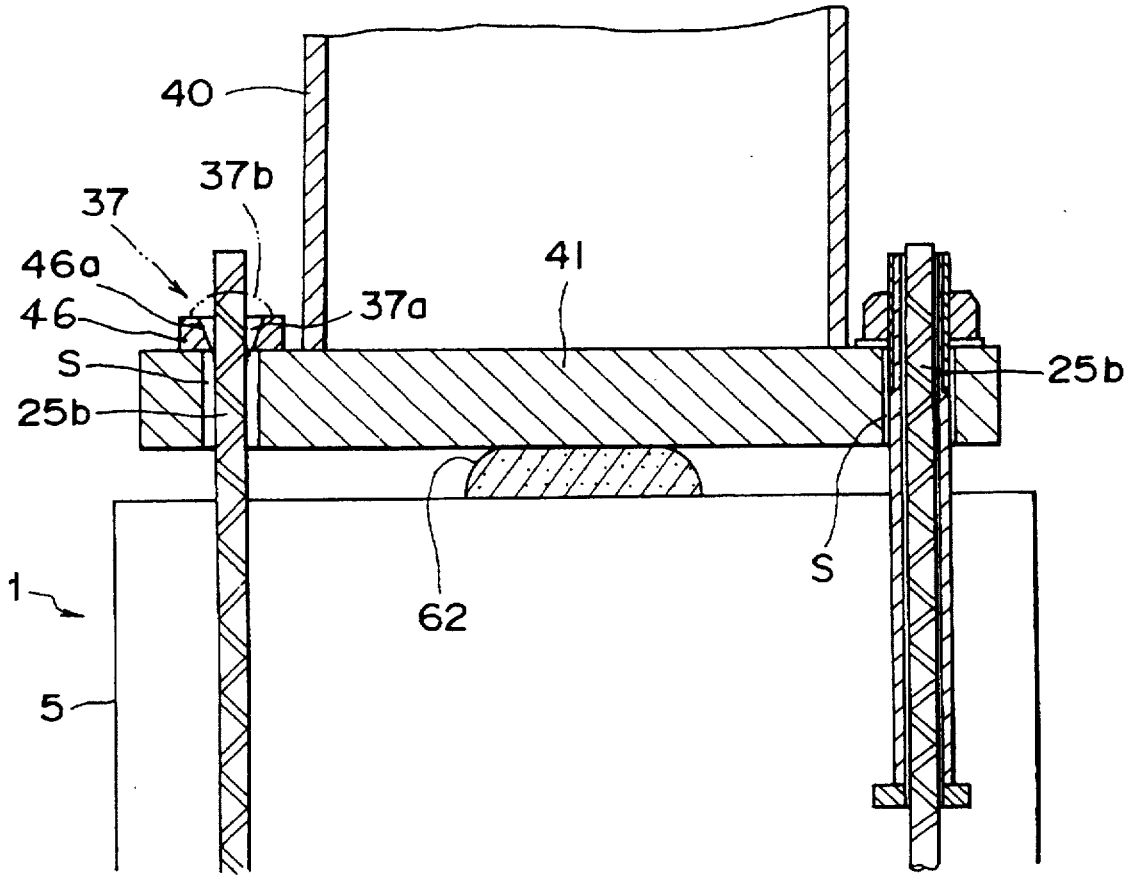
FIG. 9 is a vertical sectional view of an upper part of foundation at time of caulking process of column reinforcing-bar of column steel frame.
Figure 10:
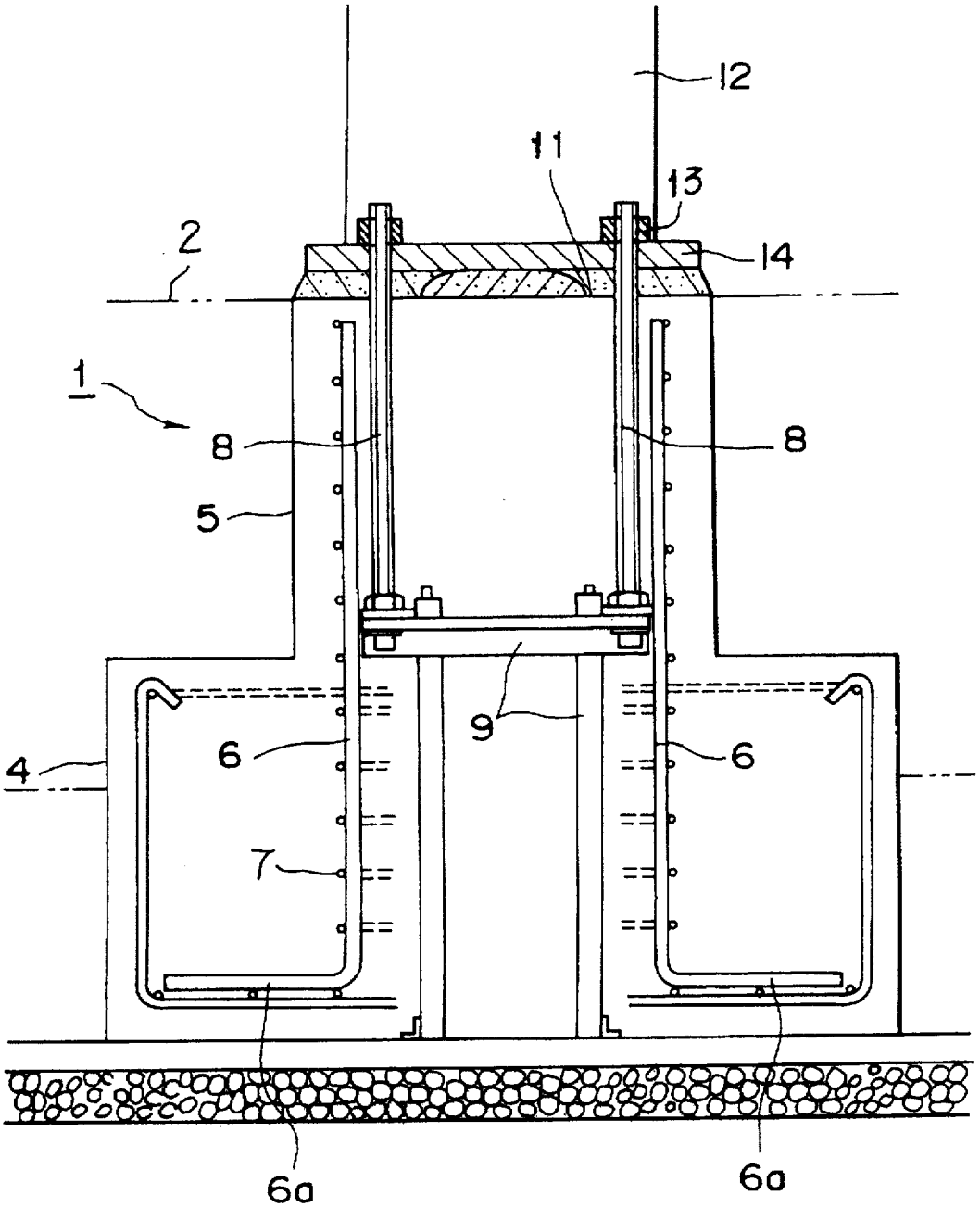
Prior art Fig. 10
FIG. 10 is an oblique view of conventional example.

(14) As illustrated at left side of FIG. 9, caulking seats 46 having tapered holes 46a enlarged toward upside are fitted onto upward protruding portions **25*b* of the column main reinforcing-bars 25 other than those at four corners, and they are placed on the base plate 41**.

(15) The upper part of the column main reinforcing-bar 25 is heated and softened, and pressed downward by a proper pressing tool so as to form the widened portion 37. The widened portion 37 is pressed and widened in the tapered hole **46*a*, so as to integrally form the conical portion 37*a* fitted in and contacting with the hole 46*a* and the umbrella-shaped portion 37*b* formed on an upper part of the conical portion 37*a* and contacting with a top surface of the sealing seat 46. In this process, the widened portion 37 has the tapered fitting structure as described above. Therefore, as the formation of the widened portion 37 progresses, the seat 46 is automatically positioned to be coaxial with the column main reinforcing-bars 25** within a range of clearance S, and a construction error is absorbed within a range of the clearance S.

(16) Non-shrinkable mortar is filled in the clearance between the base plate 41 and the top face 29 so as to form the non-shrinkable mortar layer 30 as shown in FIG. 1. At the same time, the bond is filled in the clearance between the sleeve anchor 33 and the column main reinforcing-bars 25 to form the bond layer 32, so that the sleeve anchor 33 is firmly combined to the column main reinforcing-bar 25.

(Other embodiments)

(1) A structure of base of column or a construction method of base of column may be used, in which the foundation column main reinforcing-bars are combined with the foundation column steel frame by using the caulking, at all.

(2) A structure of base of column or a construction method of base of column may be used, in which the foundation column main reinforcing-bars are combined with the foundation column steel frame by using the male threaded portions formed on the upper protruding portion of the column main reinforcing-bars and the nut screwed on them, at all.

(3) As a structure or a construction method for forming the male threaded portions on the upper protruding portions of the column main reinforcing-bars, it is possible to directly cut the male threads on the upper protruding portions of the column main reinforcing-bars and the nuts are screwed on them, in place of securing the sleeve anchors separated from the column main reinforcing-bar as shown by FIG. 1.

(4) In such a case where the column steel frame 40 together with the column main reinforcing-bars surrounding it are installed on the foundation 1 of FIG. 1, the base plate 41 is combined to the upper end portions of the column main reinforcing-bars 25 of the foundation 1 as described above, and at the same time lower end portions of the column main reinforcing-bars around the column steel frame are combined to them. As a definite structure, long nuts are used for the tightening nuts 49 of FIG. 1, and the base plate is tightened by the long nuts and the lower end portions of the column main reinforcing-bars around the column steel frame are screwed onto upper halves of the long nuts.

What is claimed is:

1. A construction method for forming a base of a column at a foundation, said method comprising the steps of:

forming a foundation such that upper ends of column main reinforcing-bars protrude upward out of the foundation, positioning a base plate for a column frame such that the upper end protruding portions of the column main reinforcing-bars extend through column main reinforcing-bar passing holes of the base plate, and heating and pressing the upper end protruding portions of the column main reinforcing-bars to form widened portions which secure the base plate to the column main reinforcing-bars.

2. A construction method for forming a base of column at a foundation, said method comprising the steps of:

forming a foundation such that upper ends of column main reinforcing-bars protrude upward out of the foundation, positioning a base plate for a column frame such that the upper end protruding portions of the column main reinforcing-bars extend through column main reinforcing-bar passing holes of the base plate, placing sealing seats having tapered holes enlarged toward the top on upper parts of respective passing holes, and heating and pressing the upper end protruding portions of the column main reinforcing-bars to form widened portions having conical portions which engage the tapered holes to secure the base plate to the column main reinforcing-bars.

3. A construction method for forming a base of column at a foundation, said method comprising the steps of:

forming a foundation such that upper ends of column main reinforcing-bars protrude upward out of the foundation, positioning a base plate for a column frame such that the upper end protruding portions of the column main reinforcing-bars extend through column main reinforcing-bar passing holes of the base plate, screwing nuts onto male threaded portions formed on the outer peripheral sides of the upper end protruding portions of some column main reinforcing-bars so as to adjust a verticality of column main steel frame, and heating and pressing the upper end protruding portions of the other column main reinforcing-bars to form widened portions which secure the base plate to the column main reinforcing-bars.

* * * * *